United States Patent [19]

Brandl

[11] Patent Number: 4,620,836

[45] Date of Patent: Nov. 4, 1986

[54] OIL PUMP WITH OSCILLATING PISTON

[76] Inventor: Gerhard Brandl, Leonhardstrasse 79, A-8010 Graz, Austria

[21] Appl. No.: 519,767

[22] PCT Filed: Nov. 10, 1982

[86] PCT No.: PCT/AT82/00031

§ 371 Date: Jul. 11, 1983

§ 102(e) Date: Jul. 11, 1983

[87] PCT Pub. No.: WO83/01816

PCT Pub. Date: May 26, 1983

[30] Foreign Application Priority Data

Nov. 16, 1981 [AT] Austria ..... 4945/81

[51] Int. Cl.[4] ..... F04B 35/00; F02D 39/10

[52] U.S. Cl. ..... 417/364; 417/380; 417/397; 417/510; 123/46 A

[58] Field of Search ..... 417/364, 380, 324, 323, 417/397, 510, 515, 11, 505, 507; 123/46 R, 46 A, 61 R, 451; 91/275

[56] References Cited

U.S. PATENT DOCUMENTS

| | | | |
|---|---|---|---|
| Re. 20,254 | 1/1937 | Robertson | 123/451 |
| 1,657,373 | 1/1928 | Danielsson | 123/451 |
| 2,454,138 | 11/1948 | Delzer | 417/364 |
| 2,754,654 | 7/1956 | Kholucy | 417/11 |
| 2,914,909 | 12/1959 | Kubik | 417/364 |
| 3,024,591 | 3/1962 | Ehrat et al. . | |
| 3,065,703 | 11/1962 | Harman | 417/364 |
| 4,097,198 | 6/1978 | Herron | 417/380 |
| 4,297,083 | 10/1981 | Von Petery | 417/505 |

FOREIGN PATENT DOCUMENTS

| | | |
|---|---|---|
| 1480100 | 11/1969 | Fed. Rep. of Germany . |
| 2648958 | 5/1978 | Fed. Rep. of Germany . |
| 993920 | 11/1951 | France . |
| 2306384 | 10/1986 | France . |
| 400777 | 4/1966 | Switzerland . |
| 430626 | 8/1967 | Switzerland . |
| 506 | of 1909 | United Kingdom . |

*Primary Examiner*—Cornelius J. Husar
*Assistant Examiner*—Peter M. Cuomo
*Attorney, Agent, or Firm*—Kurt Kelman

[57] ABSTRACT

A positive displacement machine, particularly an internal combustion engine, comprises an oscillating piston connected to a piston pump. The cylinder of the pump is connected through valves to a pressure accumulator and to a substantially pressureless tank. The piston of the motor is integral with the piston of a pump. The valves of the pump are positively actuated by a separate motor.

11 Claims, 2 Drawing Figures

OIL PUMP WITH OSCILLATING PISTON

Figure 1:
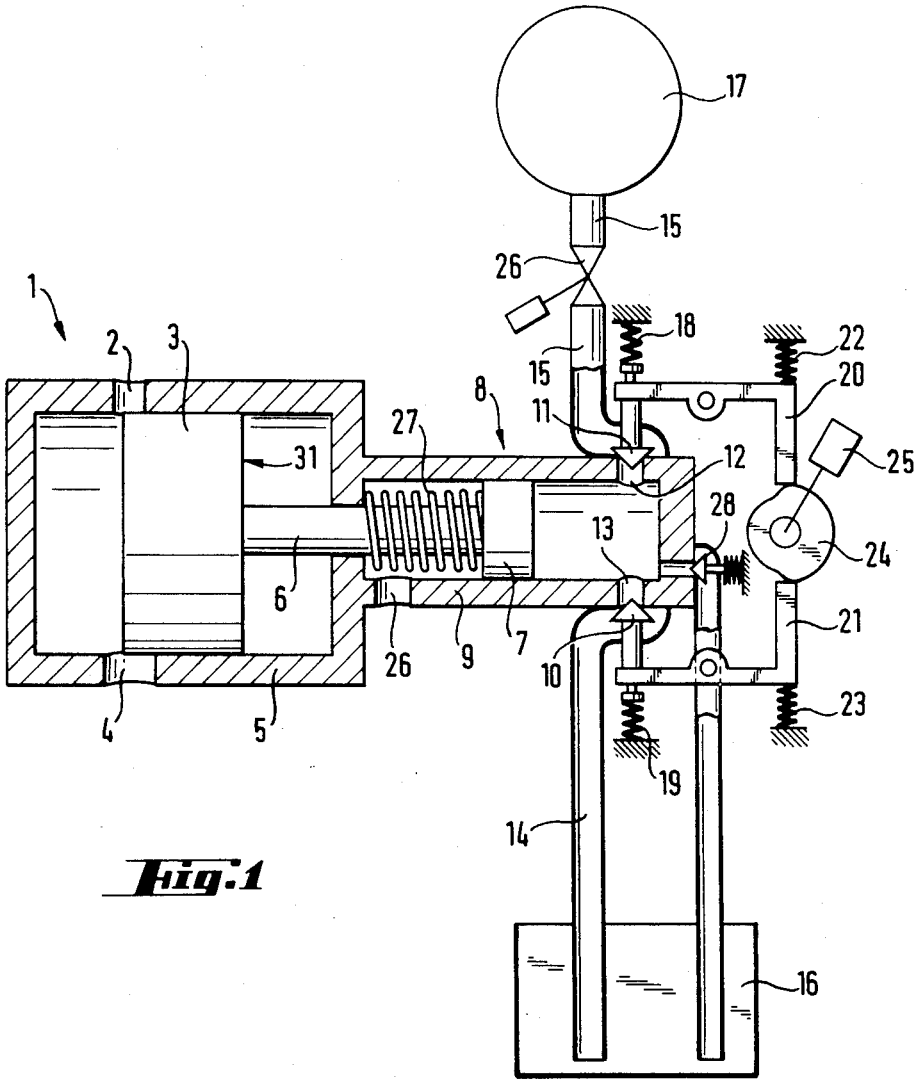

The invention relates to a pressure system apparatus which includes a cylinder-piston arrangement, preferably a component of an internal combustion engine, which is connected to a piston pump, and includes an oscillating piston, and wherein the cylinder of the pump is connected through valves with a pressure accumulator and a substantially pressureless tank.

Arrangements of this type serve mostly to convey pressure media from a tank under pressure into a pressure accumulator, the drive of the pump usually being accomplished through an internal combustion engine. In special cases, for example, when pressure from one pressure system is to be built up in another pressure system, without there arising a transfer of the pressure medium, it can, however, also happen that the cylinder-piston arrangement provided for the drive of the pump is operated by a pressure medium.

In known arrangements of this type, the drive of the pistons of the pump is accomplished through an eccentric shaft and a connecting rod, the eccentric disk being driven by a crankshaft and a piston rod and, optionally by a gear by means of the piston of the cylinder-piston arrangement. The valves of the pump are pressure controlled in known arrangements of this type, or are rotary slide valves and are controlled in dependency of the position of the piston of the pump.

These known arrangements therefore have a considerable disadvantage, based on their complicated construction and, in the case of an internal combustion motor, require a starting device.

It is an object of the invention to propose an arrangement of the initially described type, which is characterized by a simple construction, and wherein a separate starting device can be dispensed with.

According to the invention, this is accomplished by the piston of the cylinder-piston arrangement being rigidly connected with at least one piston associated with a pump, and by the valves of the pump, which may be slide valves, being positively controlled, the drive of the control of the valves being a separate motor independent of the cylinder-piston arrangement.

This results in a very simple construction, wherein the very expensive balancing of the rotating eccentric masses required in the case of crankshafts and eccentric disks is dispensed with. Furthermore, the positive control of the valves of the pumps permits the use thereof for starting of the internal combustion engine, by the valves being controlled in the same manner as in normal operation, and by the pistons of the pump being operated on with a pressure medium arriving from the pressure accumulator. Discharging of the pressure medium from the pump cylinder is accomplished by the spring action of the compressed gas cushion in the cylinder of the internal combustion engine in the event ignition arises by the effect of the combustion in the cylinder of the engine. In each case, the pistons connected to one another are induced to oscillate at a frequency equal to the frequency of the positive control of the valves through operation of the pump with a pressure medium, and by control of the valves of the pump.

Due to the effect of the combustion in the cylinder of the engine, the oscillation of the piston arrangement is advanced in phase with respect to the control of the valves driven at a constant frequency, and there results a discharge of the pressure medium into the pressure accumulator, and a suction from the substantially pressureless tank.

Rotary slide valves which are driven by a ratchet belt drive or a gear drive by a separate motor provide a particularly simple structure.

According to a further feature of the invention, the control of the valves of the pump is accomplished by a common cam disk and by rams controlled thereby which results in a very simple construction in which the opposite phase position of the valves always corresponds to the predetermined values. Particularly in this solution, there cannot arise any changes in the phase position during any changes of the number of revolutions of the drive of the valve control, such as would be possible in separate cam disks which are, for example, coupled through a belt- or chain-drive.

Furthermore, a very advantageous solution with respect to the adjustment of the opposite position of the opening- and closing-time intervals of the two valves of a pump is characterized by the connection of the pistons of the cylinder-piston arrangement with the pistons of the pump being accomplished through a straight rod, and wherein the free front face of this rod optionally forms the piston surface area of the pump.

In an inventive arrangement in a cylinder-piston arrangement forming a component of as an internal combustion engine, it is provided according to a further feature of the invention, that the piston of the cylinder-piston arrangement is connected through a straight rod with two pistons of two pumps, and wherein it is particularly advantageous if the pistons of the two pumps are connected to the piston of the cylinder piston arrangement through equally formed straight rods projecting from respective front sides of the pistons of the cylinder-piston arrangement, and if the inlet- and outlet openings of the cylinder housing of the cylinder-piston arrangement are arranged in its center region.

Consequently, it is particularly easy to start an internal combustion engine by applying a pressure medium to the pump.

The gas exchange in the cylinder-piston arrangement of an internal combustion engine is accomplished by utilization of the gas oscillations in the suction- and exhaust-tubes in a manner as is usual in internal combustion engines, and wherein an optimization of the suction- and gas-interchange conditions is possible in a simple manner in view of the constant frequency of the oscillations of the piston. The gas interchange can further be supported by a blower.

Combustion can be accomplished by spark ignition as in the case of the Otto motor, by injection of fuel into highly compressed air, such as in the case of a diesel engine, or by blowing in of ignitable gas during the compression stroke and subsequent ignition of the so formed ignitible mixture in view of the high temperatures arising during compression.

A particularly preferred embodiment of an inventive arrangement is characterized by the rods serving for connection of the pistons sliding in surrounding guides, in which each includes one annular groove worked into a bore thereof, and a bore connected with a fuel supply line extending radially and spaced axially from the annular groove in a direction towards the pump, which bore optionally communicates with a further annular groove, and wherein each rod is provided with two recesses, preferably endless recesses, axially spaced from one another, which in various positions of the pistons of the cylinder-piston arrangement establish communication from the annular groove to the combustion chamber of the cylinder-piston arrangement or from the annular groove to the bore connected with the fuel supply line.

In this embodiment, ignitable fuel can pass through an annular gap, which is formed by the annular groove of the rod connecting the pistons which is closer to the cylinder of the internal combustion engine, and which opens briefly during the compression stroke, so as to connect the combustion chamber with the annular groove of the bore of the guide serving as a supply chamber, from which the ignitable fuel disposed therein and being under pressure, flows into the combustion chamber, and is mixed with air therein. The ignitable fluid flows at the upper dead point of the piston of the internal combustion engine into the annular groove of the bore of the guide through a second annular gap formed by the second annular groove of the piston rod. As a result of this construction, there arises the advantage of a lower number of movable parts, as the rod connecting the pistons simultaneously controls the supply of fuel to the combustion chamber of the internal combustion chamber. Consequently, by means of a suitable valve, pressure of the combustible gas can be controlled so as to match the amount flowing in, and therefore the output provided, to the demand. The output can be controlled in dependence of the pressure in the accumulator in such a manner that it increases in the accumulator in the case of a decreasing pressure, and so that the pressure remains substantially constant independently of any discharge of the pressure medium from the accumulator.

Either a gaseous fuel or vaporized liquid fuel can be used as combustible gas. Evaporation of liquid fuel can be accomplished either by utilization of the exhaust heat in a suitable thermostatically controlled heat exchanger, or by means of an agitator, which transforms mechanical energy in a small chamber into heat, and therefore vaporizes the fuel. The drive of the agitator can advantageously be accomplished by means of a hydraulic motor, or by a small turbine upon which pressure is exerted by the accumulator.

The invention wil be illustrated with the aid of the drawing which schematically illustrates two embodiment of the invention.

Figure 2:
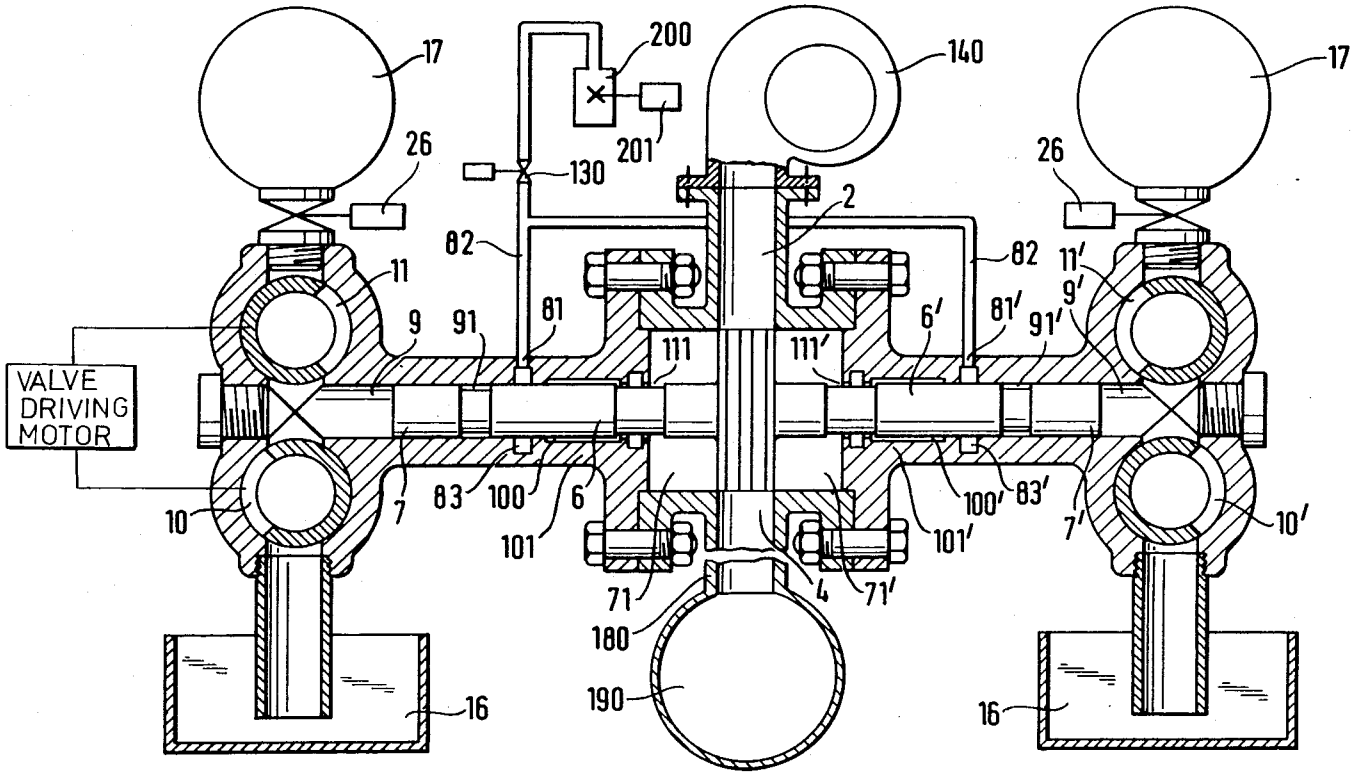

FIG. 1 shows an embodiment of an internal combustion engine with only one pump per cylinder FIG. 2 shows an embodiment with two pumps per cylinder.

According to FIG. 1, the internal combustion engine 1 is a two cycle motor, in which the inlet 2 is, for example, connected to a non-illustrated carburetor. Of course, fuel injection would also be feasible, where the control of the injection would have to be carried out in dependence of the position of the piston 3 of the internal combustion engine. Although the piston 3 is a flat piston, a piston provided with a projection can also be used. Furthermore, as this is not a component of the invention, the conventional piston rings have not been shown for reasons of simplicity.

The exhaust opening 4 in the cylinder housing 5 is connected to conventional and non-illustrated sound dampers, for example, exhaust pots.

The piston 3 of the internal combustion engine 1 is connected by means of the rod 6 to the piston 7 of the pump 8, whose cylinder housing 9 is aligned axially with the cylinder housing 5 of the internal combustion engine 1, and connected to the latter, optionally also in one piece, in relation to the housing halves.

Cylinder housing 9 of the pump 8, whose piston 7 can, optionally, also be formed by the rod 6 or its free front surface, defines two openings 12, 13 closable by valves 10, 11, which openings 12, 13 are connected through tubes 14, 15 to a tank 16 for the pressure medium and to a pressure storage device 17, respectively.

The valves 10, 11 are under prestress of the springs 18, 19 which hold the valves in closed position. The control of the valves is accomplished by means of the rams 20, 21, which are held by the springs 22, 23 in contact with the cam disk 24, which, in turn, is driven by the motor 25. The motor 25, which is preferably an electric motor, includes a non-illustrated arrangement which ensures that it comes to a standstill only in a certain position of the cam disk 24, in which the valve 11 is securely closed, and the valve 10 is maintained open. Furthermore, in the tubular conduit 15 there is disposed a valve 26 which closes as soon as the current supply of the motor 25 is interrupted.

So as to avoid formation of a gas cushion on the rear side of the piston 7, there is provided in the cylinder housing a venting hole 26.

For operation of the illustrated arrangement, it is sufficient to set the cam disk 24 in rotation by means of the motor 25, and to let the pressure medium stream into the pump 8 from the pressure storage device 17 through the open valve 26 and the valve 11, the valve 10 being closed by the cam disk 24. Thus, the piston 7 is pushed back, and the piston 3, after passing by the inlet- and outlet-openings 2, 4, compresses the gas cushion disposed in the cylinder housing 5. This gas cushion acts as a spring and drives the two pistons 3 and 7 back again after closure of the valve 11, and opening of the valve 10, which is effected by the rotation of the cam disk 24, inertia causing the pistons 3, 7 to pass by the inlet- and outlet-openings 2, 4, the prepared fuel mixture being sucked in from non-illustrated carburetor. This mixture is again compressed as soon as the valve 10 closes and the valve 11 opens, and the pressure medium streams into the pump 8.

As soon as the frequency of the oscillating movement of the pistons 3, 7 has increased sufficiently, based on the increasing number of rotations of the motor 25, and has reached the operating value, sufficient fuel mixture is sucked in, and during the subsequent compression, ignition of the mixture results, either by ignition upon reaching of the critical pressure, or by a separate ignition by means of a non-illustrated arrangement, which is controlled in dependence of the position of the piston 3, or by the pressure in an end of the cylinder housing 5 facing away from the pump 8.

Upon combustion of the fuel mixture, the pistons 3 and 7 are driven back very quickly prior to closure of the valve 11, whereby the medium disposed in the cylinder housing 9 is discharged through the valve 11 to the pressure storage device 17. As a result of the following spring-like action of the gas cushion, which is locked in by compression between the rear side 31 of the piston 3 and the front face of the cylinder housing 5 facing it, the pistons 3, 7 are again driven forwardly, as a result of which pressure medium is sucked in from the tank 16 through the open valve 10. Simultaneously, the fuel mixture sucked in by the pistons driven back by the previous combustion is again compressed and subsequently ignited.

During transition from starting the engine to its normal operation, in which the pressure medium in the cylinder housing 9 of the pump 8 is decompressed while supplying mechanical work, the number of revolutions of the motor 25 driving the cam disk 24 remains constant and only the phase position of the pistons 3 and 7 is changed with respect to the position of the valves 10, 11 and of the cam disk 24.

For stopping the engine, it is sufficient to interrupt supply of fuel to the internal combustion engine 1, and to stop the motor 25. The latter can be accomplished with a small delay. While the motor 25 is slowing down, the oscillation frequency of the pistons 3 and 7 is reduced in the same measure as the number of revolutions of the cam disk 24, the cam disk 24 being stopped in a position in which the valve 11 is closed but the valve 10 remains open.

So as to ensure a position of the pistons 3, 7 following stopping of the engine which permit restarting thereof, there is provided a spring 27 which urges the piston 7 rightwards, so that is cannot remain positioned in the left end position, in which a self-actuating starting by means of the pressure medium would be impossible.

For the avoidance of any greater damage in the case of a failure of the valve control, there is provided a spring loaded safety valve 28 which permits the pressure medium to escape in the event of a malfunction, for example combustion of the fuel mixture in the cylinder housing 5 when valves 10 and 11 of the pump 8 are both closed.

In the embodiment of FIG. 2, the piston of the internal combustion engine is connected rigidly with the pump pistons 7, 7' through the rods 6, 6'. This piston arrangement is set into oscillation by the pressure oil from the pressure container 17, as the pressure oil streams into the cylinder housings 9, 9' through the valves 11, 11', and acts alternately on the pump piston 7, 7', the valves 11, 11' being rotary slide valves and being driven by a separate non-illustrated motor. In the pressureless time interval following the pressure interval, the cylinder housings 9, 9' are connected to the substantially pressureless tank 16 through the rotary slide valves 10, 10' running at the same number of revolutions and and the liquid is discharged. The gas cushions in the cylinder chamber 71, 71' thereby serve as springs, and support the pistons 7, 7' of the pumps 8, 8' alternately acted upon.

By ignition of the ignitable fuel mixture in the cylinder chambers 71, 71', there results a combustion of this ignitable gas mixture in view of the high temperatures arising during the compression of the gas cushion. Due to the pressure of the combustion in the cylinder chambers 71, 71' the piston arrangement consisting of the pistons 3, 7 and 7' advances in phase with respect to rotation of the rotary slide valves 10, 11 and 10', 11', and there results a discharge of the pressure medium into the pressure container 17, and a suction from the substantially pressureless supply tank 16. The higher the combustion pressures, the more the piston arrangement advances in phase ahead of the rotary slide valve rotation, and the more pressure medium is supplied to the tank 17.

If the piston arrangement is in the right end position, the circular groove 83 connected through a radially extending bore 81 with a fuel supply line 82 is connected with a supply chamber through the circular groove 91 of the rod 6, the supply chamber being formed by a circular groove 100 of the guide 101 of the rod 6, and the ignitable fuel being under pressure in the circular groove 83 flows through the circular groove 91 to the circular groove 100.

In the right end position of the piston arrangement 3, 7, 7' the gas mixture disposed in the cylinder chamber 71' at the right of the piston 3 is ignited, the combustible gas having flowed into the cylinder chamber 71' through the circular groove 111' of the rod 6' of the circular groove 100' serving as a storage chamber prior to reaching the extreme right position of the piston arrangement.

If the piston arrangement is again moved leftwardly by the combustion in the right cylinder chamber 71', then the circular groove 111 connects the circular groove 100 serving briefly as a supply chamber with the cylinder chamber 71, and the combustible gas flows into the cylinder chamber 71, and is admixed there with the combustible air. This gas mixture is now compressed and ignited.

Due to the movement of the piston arrangement to the left necessarily resulting from a combustion in the right cylinder chamber 71', the air which has streamed rightwardly into the cylinder chamber 71 during the previous movement of the piston arrangement is compressed, and after opening of the input opening 2, fresh air compressed by the blower 140 is blown into the cylinder chamber 71', and simultaneously the combustion gases are discharged by the outlet opening 4, which has also been opened, so that the combustion gases reach the output connector 190 through the exhaust tube 180.

After passage of a certain path distance to the left, the circular groove 111 connects briefly the circular groove 100 of the guide 101 of the rod 6 with the cylinder chamber 71, the circular groove 100 serving as the supply chamber, and the ignitable gas streams into the cylinder chamber 71, and is mixed with the combustion air which has been precompressed therein. This gas mixture is further compressed by the piston 3 moving towards the left and, prior to reaching the left end position, the connection between the circuit groove 100 and the left cylinder chamber 71 is again closed by the rod 6. By the compression of the gas mixture in the left cylinder chamber 71 a combustion of the mixture arises within the region of the left end position of the piston arrangement.

While approaching the left end position of the piston arrangement 3, 7, 7', the circular groove 83', which is connected through a radially extending bore 81' with a fuel supply line 82, is connected by the circular groove 91' of the rod 6' to a supply chamber, which is formed by a circular groove 100' of the guide 101' of the rod 6', and the combustible fuel under pressure in the circular groove 83' streams through the circular groove 91' into the circular groove 100'. Wherefrom it passes during approachment of the piston 3 to its right end position through the circular groove 111' into the cylinder chamber 71'.

The pressure of the combustible gas in the circular groove 83 is adjusted by means of the regulating valve 130.

The ignitable gas is produced by vaporization of liquid fuel, for which there is provided an agitator 200 provided with a drive, for example a hydraulic turbine 201, vaporization being achieved by mechanical energy supplied to the liquid and by expelling of small fluid particles.

I claim:

1. A pressure system apparatus connected to a cylinder-piston arrangement of an internal combustion engine for oscillating the piston of the arrangement in opposite directions whereby the piston assumes different positions in the cylinder, the cylinder defining a combustion chamber having inlet and exhaust openings substantially centered between the ends of the cylinder, which comprises a gas cushion resiliently holding the piston in the cylinder; two piston pumps; and substantially identical straight rods extending from the piston of the arrangement in opposite directions for connection to the pump pistons, and each piston pump including a pump cylinder and a pump piston reciprocable therein, the pump piston being rigidly connected to the piston of the arrangement, a first storage device containing a pressure medium, a second storage device held substantially pressureless, conduit means connecting the pump cylinder to the storage devices and permitting flow of the pressure medium between the storage devices and the pump cylinder, a respective valve selectively permitting and stopping flow of the pressure medium from the first storage device into the pump cylinder and flow of the pressure medium from the pump cylinder into the second storage device, and a separate motor controlling the valves independently of the position of the piston in the cylinder of the arrangement; and further comprising a respective guide surrounding the straight rods for glidingly guiding the rods, each guide defining an annular groove surrounding the rod glidingly guided therein and a radial bore spaced from the annular groove towards the pump piston, fuel supply conduit means connected to the radial bores, and each straight rod defining two axially spaced annular grooves, the axially spaced annular grooves alternately connecting the combustion chamber and the radial bores leading to the fuel supply conduit means to the annular grooves in the guides in dependence on different positions of the piston in the cylinder of the arrangement.

2. The pressure system apparatus of claim 1, wherein the conduit means comprises respective conduits connecting the pump cylinder to the first and second storage devices, the conduits having substantially the same flow resistance.

3. The pressure system apparatus of claim 1, wherein the valves are slide valves.

4. The pressure system apparatus of claim 1, wherein the guides define additional annular grooves in communication with the radial bores.

5. The pressure system apparatus of claim 1, further comprising a storage tank for liquid fuel, the fuel supply conduit means connecting the storage tank to the radial bores, and a rotatable agitator in the storage tank for vaporizing the liquid fuel.

6. The pressure system apparatus of claim 5, further comprising a turbine operated by the pressure medium for driving the agitator.

7. An apparatus which comprises a cylinder-piston arrangement including a cylinder, a piston mounted in the cylinder for oscillation and means resiliently pressing against the piston during oscillation in both directions of oscillation; and a piston pump connected to the piston of the cylinder-piston arrangement for oscillating the same, the pump including a pump cylinder, a pump piston reciprocable therein and rigidly connected to the piston of the cylinder-piston arrangement, a first storage device containing a pressure medium, a second storage device held substantially pressureless, conduit means connecting the pump cylinder to the storage devices and permitting free flow of the pressure medium between the storage devices and the pump cylinder, a respective valve in the conduit means periodically permitting the free flow and stopping the flow of the pressure medium from the first storage device into the pump cylinder and from the pump cylinder into the second storage device in a respectively open and closed position of the valves, and a separate motor periodically actuating the valves into the open and closed positions independently of the position of both pistons and of the pressure in the cylinders.

8. The apparatus of claim 7, further comprising a cam disk driven by said motor and rams periodically operated by the driven cam disk for periodically actuating the valves into the open and closed positions.

9. The apparatus of claim 7, further comprising a straight rod rigidly connecting the piston of the cylinder-piston arrangement to the piston of the pump.

10. The apparatus of claim 7, wherein the cylinder-piston arrangement is an internal combustion engine, including two of said piston pumps and a straight rod connecting the engine piston to the pistons of the pumps.

11. The apparatus of claim 7, wherein the means resiliently pressing against the oscillating piston comprise a gas cushion.

* * * * *